US008110758B2

(12) United States Patent
Lin

(10) Patent No.: US 8,110,758 B2
(45) Date of Patent: Feb. 7, 2012

(54) MODE DIAL MECHANISM AND ELECTRONIC DEVICE HAVING THE SAME

(75) Inventor: Tzu-Chih Lin, Hsinchu (TW)

(73) Assignee: Altek Corporation, Hsinchu (TW)

( * ) Notice: Subject to any disclaimer, the term of this patent is extended or adjusted under 35 U.S.C. 154(b) by 394 days.

(21) Appl. No.: 12/413,710

(22) Filed: Mar. 30, 2009

(65) Prior Publication Data

US 2010/0122895 A1 May 20, 2010

(30) Foreign Application Priority Data

Nov. 20, 2008 (TW) ..... 97144907 A

(51) Int. Cl.
*H01H 19/63* (2006.01)

(52) U.S. Cl. ..... 200/14; 200/16 D; 200/564; 200/568; 200/569; 200/16 R

(58) Field of Classification Search ..... 200/4, 14, 200/16 R–16 D, 559, 563, 564, 567–574, 200/336; 341/35; 345/184; 338/47, 68, 338/96, 97, 117, 118, 125, 160–167, 173, 338/176, 184, 190, 198, 200, 215, 334, 530
See application file for complete search history.

(56) References Cited

U.S. PATENT DOCUMENTS

| | | | | |
|---|---|---|---|---|
| 5,796,058 | A * | 8/1998 | Aimi et al. | 200/16 D |
| 6,696,915 | B2 * | 2/2004 | Pan | 338/198 |
| 6,999,675 | B2 * | 2/2006 | Nishiwaki | 396/85 |
| 7,202,432 | B2 * | 4/2007 | Nishimura | 200/563 |
| 7,342,187 | B2 * | 3/2008 | Yamaguchi | 200/14 |
| 7,745,749 | B2 * | 6/2010 | Ito | 200/336 |
| 7,945,153 | B2 * | 5/2011 | Lin | 396/131 |
| 2006/0055805 | A1 * | 3/2006 | Stockton et al. | 348/333.01 |
| 2007/0170046 | A1 * | 7/2007 | Ito | 200/11 R |

FOREIGN PATENT DOCUMENTS

| | | |
|---|---|---|
| TW | 584357 | 11/2004 |

* cited by examiner

*Primary Examiner* — Michael Friedhofer
(74) *Attorney, Agent, or Firm* — Alan Kamrath; Kamrath IP Lawfirm, PA

(57) ABSTRACT

A mode dial device is set in an electrical device. The mode dial device includes a rotary member and a pressure detection module. The rotary member includes a main body, a shaft portion connecting the main body and the electrical device, and a contact portion located at the bottom of the main body with an inclined surface. The pressure detection module is electrically coupled to the electrical device and located under the rotary member. The pressure detection module includes a button portion which is movable vertically. The button portion contacts the contact portion. When the rotary member is rotated, the contact portion pushes the button portion of the pressure detection module. The pressure detection module outputs a signal according to a moving distance of the button portion.

13 Claims, 6 Drawing Sheets

MODE DIAL MECHANISM AND ELECTRONIC DEVICE HAVING THE SAME

BACKGROUND OF THE INVENTION

1. Field of the Invention

The present invention relates to a mode dial mechanism and an electronic device having the same and, specifically, to an operation mode dial mechanism applied to and required by an electronic device with a plurality of functions.

2. Description of the Related Art

An electronic device having a mode dial mechanism (e.g. a digital camera) has been available in the prior arts. A user can select the required function (e.g. a photo mode, a video mode, and a play mode) by rotating a rotary member.

In the prior arts, most mode dial mechanisms of electronic devices use a spring plate on the rotary member for contacting a plurality of electrical contact switches respectively in corresponding positions on a circuit board (e.g. ROC Patent No. 584,357). Each electrical contact switch has a corresponding function. Multiple modes of operation can be activated by contact between the spring plate and one of the electrical contact switches. Therefore, the number of the multiple operation modes has to equal the number of electrical contact switches. For example, when there are eight operation modes, the circuit board under the rotary member needs to have eight electrical contact switches.

However, when there are more required operation modes using a mode dial mechanism (such as 16 operation modes), more electrical contact switches need to be disposed within the same area under the rotary member. This results in a need for smaller electrical contact switches, which increases the manufacturing costs of the components greatly and also increases the degree of difficulty in assembly.

In addition, there are gaps between the electrical contact switches. When the user incautiously turns the spring plate of the rotary member to the gap between adjacent electrical contact switches, the spring plate does not contact any electrical contact switch. The electronic device, as a result, cannot determine the operation mode selected by the user, so the electronic device can not work properly.

Therefore, it is desirable to provide a mode dial mechanism and an electronic device having the same to mitigate and/or obviate the aforementioned problems.

SUMMARY OF THE INVENTION

A primary object of the present invention is to provide a mode dial mechanism used for an electronic device for the switch between operation modes and an electronic device having the mode dial mechanism.

Another object of the present invention is to provide a mode dial mechanism and an electronic device having a mode dial mechanism which simplifies the required mechanism for the electronic device to switch between operation modes.

An additional object of the present invention is to provide a mode dial mechanism and an electronic device having the mode dial mechanism which simplifies the process of installing the mode dial mechanism in the electronic device.

A further object of the present invention is to provide a mode dial mechanism and an electronic device having the mode dial mechanism which reduces the failure rate of the switch between operation modes of the electronic device.

In order to achieve the above-mentioned objectives, the present invention discloses a mode dial mechanism of an electronic device, used for an electronic device, comprising a rotary member and a pressure detection module. The rotary member comprises a main body with a bottom, a shaft portion connecting the main body and the electronic device, and a contact portion located at the bottom of the main body with an inclined surface. The pressure detection module is electrically coupled to the electronic device and located under the rotary member. The pressure detection module comprises a button portion which is movable vertically. The button portion contacts the contact portion. When the rotary member is rotated, the contact portion pushes the button portion of the pressure detection module, and the pressure detection module outputs a signal according to a moving distance of the button portion.

The present invention also discloses an electronic device having a plurality of operation modes includes a rotary member comprising a main body with a bottom, a shaft portion connecting the main body and the electronic device, and a contact portion located at the bottom of the main body with an inclined surface. A pressure detection module is electrically coupled to the electronic device and located under the rotary member. The pressure detection module includes a button portion which is movable vertically, with the button portion contacting the contact portion. When the rotary member is rotated, the contact portion pushes the button portion of the pressure detection module, and the pressure detection module outputs signals respectively corresponding to each operation mode according to a moving distance of the button portion. A central processing unit is electrically coupled to the pressure detection module and executes the corresponding operation modes according to signals output from the pressure detection module.

In accordance with one embodiment of the present invention, the pressure detection module includes a containment casing having its outside top surface close to the bottom surface of the contact portion and having a hole. An action element includes a slab with a side removably received in the containment casing. The aforementioned button portion, which is located on the top surface of the slab, passes through the hole and touches the bottom surface of the contact portion. An elastic electric member includes a fringe rod disposed around the lateral surface of the slab and a rebounding portion formed by bending the end of the fringe rod and which touches the inside bottom surface of the containment casing. A resistance member is disposed within a side of the containment casing and touching the fringe rod of the elastic electric member. When the button portion is pressed, which causes the slab to descend, the contact position between the fringe rod and the resistance member differs such that a corresponding resistance value is generated. A conductive member is disposed within a side of the containment casing different from the side on which the resistance member is located and touching the fringe rod of the elastic electric member.

Compared with the prior art electronic devices that need to have a plurality of electrical contacts on their circuit board for mode dials, the mode dial mechanism and electronic device having the same of the present invention uses a pressure detection module together with the bottom inclined plane of the rotary member of a simple structure to perform the mode switch. Its overall structure is simpler than that in the prior arts.

In addition, in the prior arts, a plurality of electrical contacts needs to be located on the circuit board, and a conductive slice linking up with the rotary member needs to be set. This results in a complex process. However, the mode dial mechanism and electronic device having the same of the present invention simply needs to have a pressure detection module connected to the electronic device, two conductive legs electrically coupled to the electronic device, and the rotary member located on and connected to the electronic device including the pressure detection module with a shaft. Its process is simpler than that in the prior arts.

Moreover, in the prior arts, when the operation-mode switch of the electronic device is performed, a conductive slice sometimes cannot precisely contact electrical contacts on the circuit board, thus resulting in a malfunction. However, the mode dial mechanism and electronic device having the same of the present invention determine the output resistance value according to the contact position between the elastic electric member of the pressure detection module and the metal board of the resistance member and then determine the switch between operation modes according to the resistance value. Therefore, its failure rate is reduced greatly.

DETAILED DESCRIPTION OF THE PREFERRED EMBODIMENTS

The advantages and innovative features of the invention will become more apparent from the following detailed description when taken in conjunction with the accompanying drawings.

Figure 1:
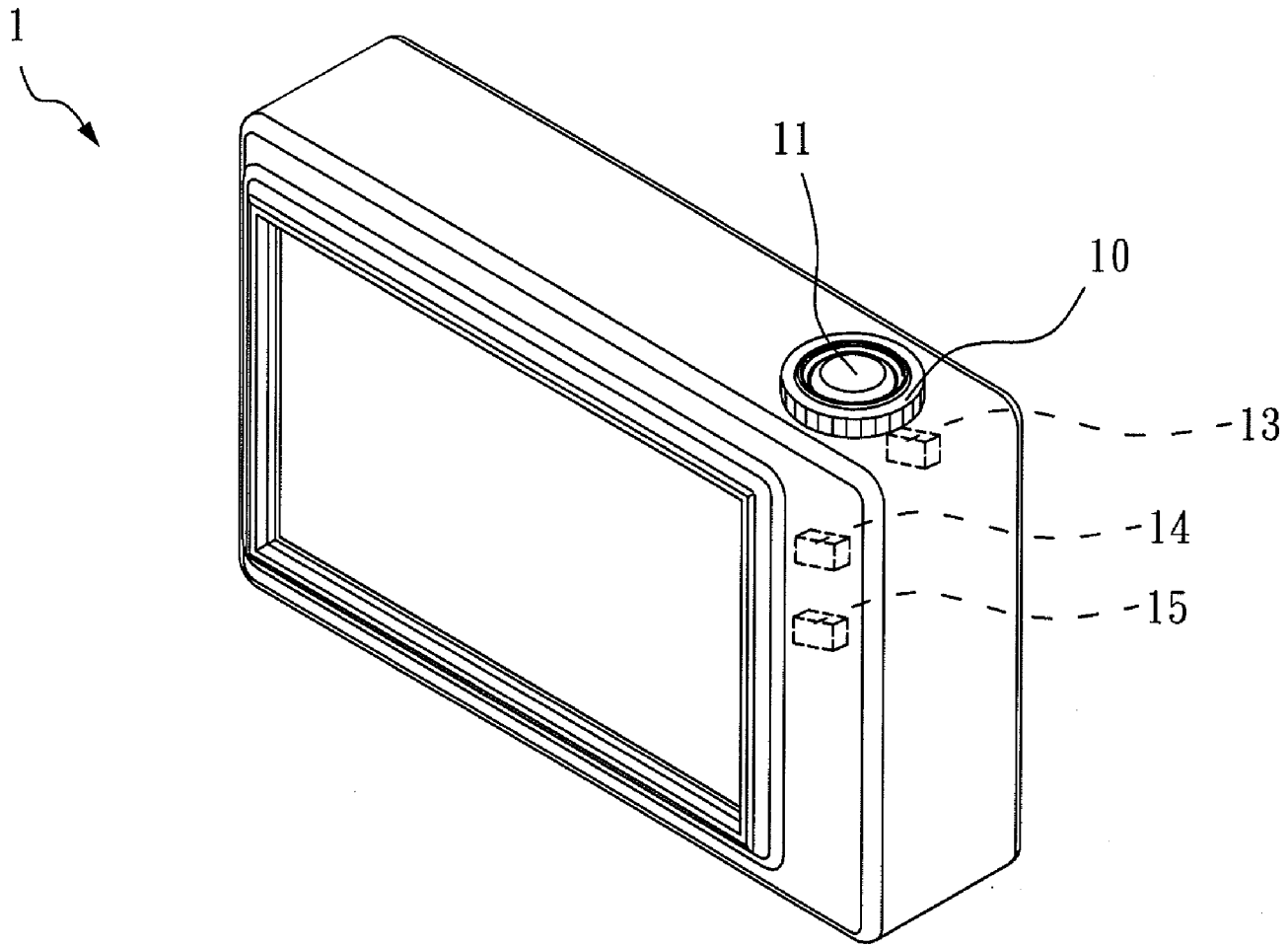
FIG. 1 is a schematic drawing of the configuration of an electronic device of the present invention.

Please refer to FIG. 1, a schematic drawing of the configuration of an electronic device of the present invention. The electronic device 1 can be, for example, a digital camera. Its casing can have a rotary member 10, a pressure detection module 13, and a shutter button 11 on the surface. Also, there can be a central processing unit 15 inside and electrically coupled to the pressure detection module 13. When the rotary member 10 is rotated, the pressure detection module 13 is driven to output different electrical signals to the central processing unit 15. The central processing unit identifies the different electrical signals and then executes a plurality of operation modes 14. The operation modes 14 can comprise a photo mode, a video mode, a play mode, a macro mode, an audio mode, and/or a moving mode, etc. When the selected operation mode 14 is a photo/video related mode, a user can capture an image by pushing the shutter button 11. Besides the digital camera of this embodiment, the electronic device 1 can also be other electronic devices with a photographing function, such as a mobile phone or a PDA.

Figure 2:
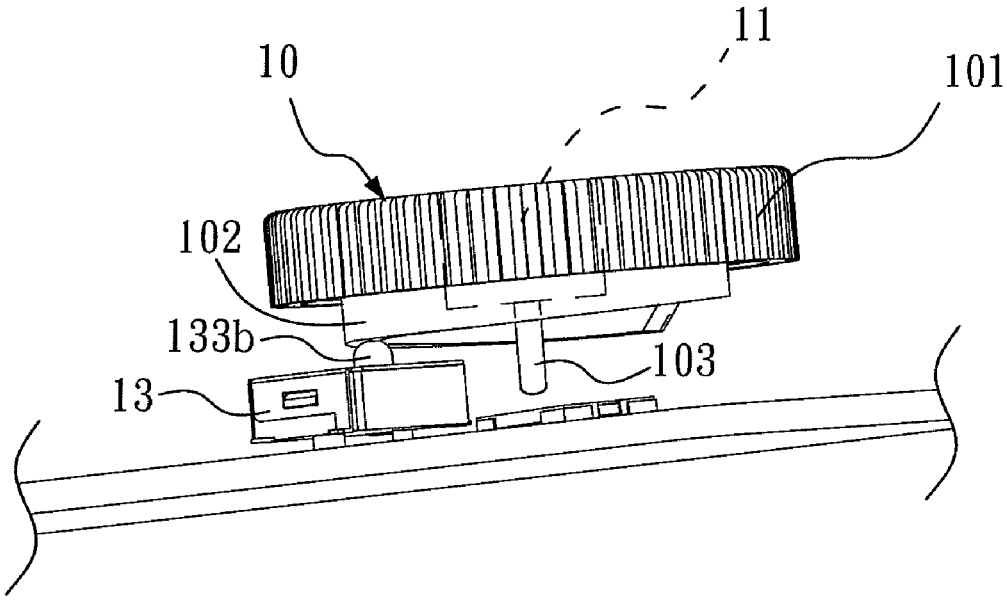
FIG. 2 and FIG. 2A are schematic drawings of a mode dial mechanism in accordance with a first embodiment of the present invention.
Figure 2A:
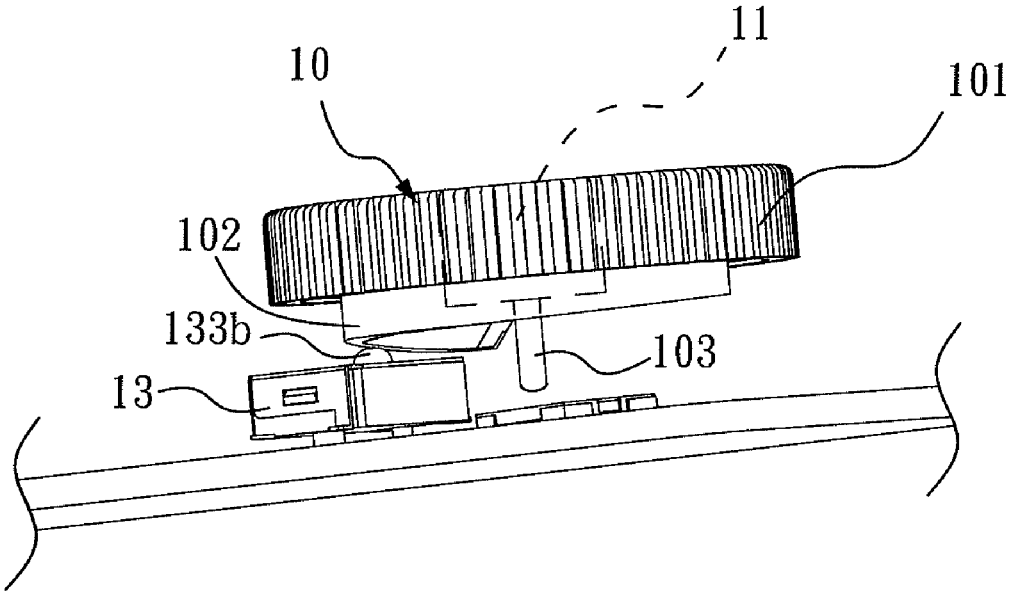

Please refer to FIG. 2 and FIG. 2A, which illustrate a first embodiment of a mode dial mechanism of the present invention. The mode dial mechanism mainly comprises the above-mentioned rotary member 10 and the pressure detection module 13. The rotary member 10 comprises a main body 101 with a bottom, a shaft portion 103 connecting the main body 101 with the electronic device 1, and a contact portion 102 located at the bottom of the main body 101 and having an annular incline on the bottom surface. The pressure detection module 13 is electrically coupled to the electronic device 1 and located under the rotary member 10. The pressure detection module 13 comprises a button portion 133*b* which is movable vertically. The button portion 133*b* contacts the contact portion 102. When the rotary member 10 is rotated, the contact portion 102 pushes the button portion 133*b* of the pressure detection module 13, and the pressure detection module 13 outputs a signal according to a moving distance of the button portion 133*b*. Since the contact portion 102 has an annular incline on the bottom surface, when the plane of the contact portion 102 that contacts the button portion 133*b* is higher, the linear deformation caused by pressure of the button portion 133*b* is smaller (as shown in FIG. 2). When the plane of the contact portion 102 that contacts the button portion 133*b* is lower, the linear deformation caused by pressure on the button portion 133*b* is greater (as shown in FIG. 2A).

Figure 3:
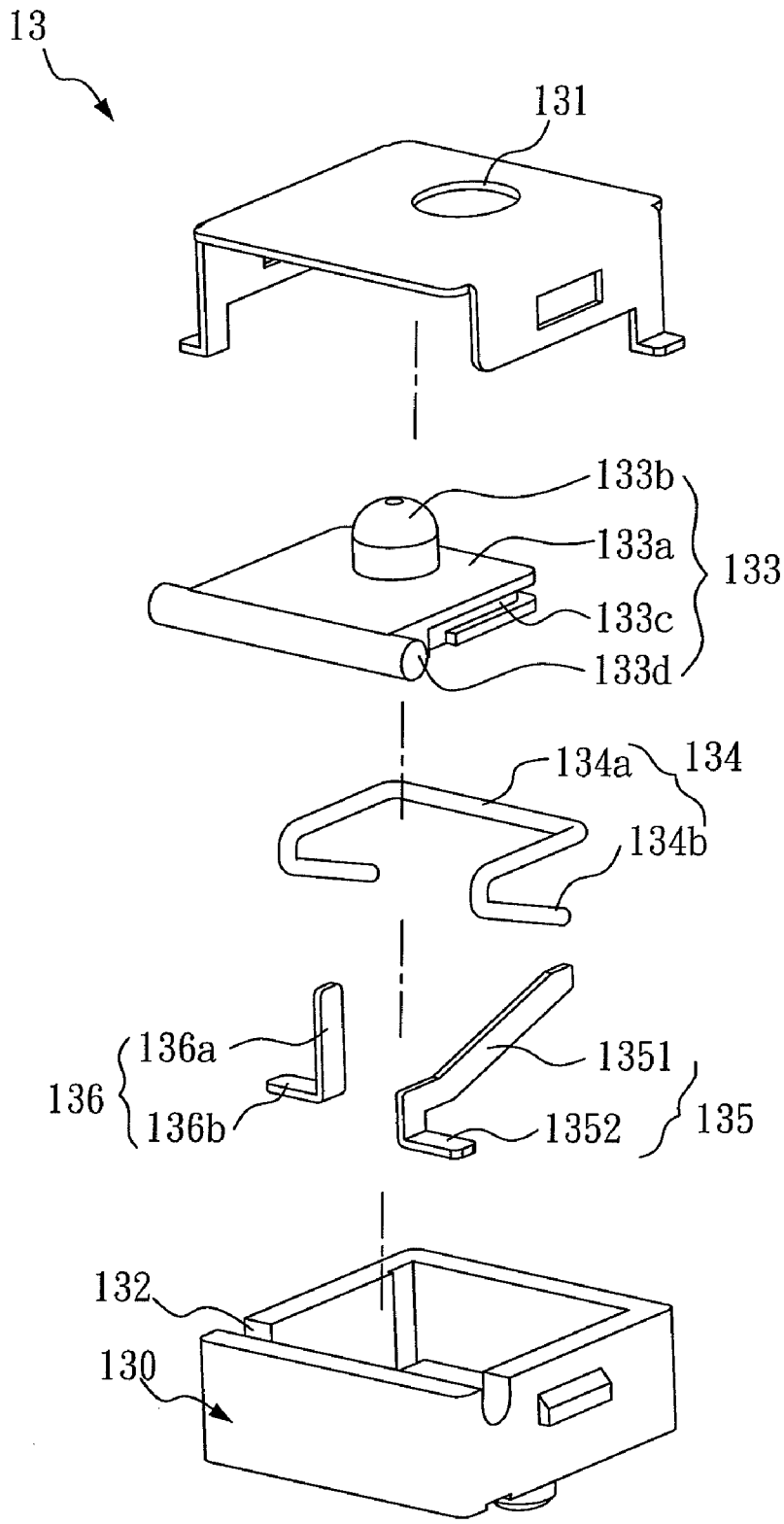
FIG. 3 and FIG. 4 are exploded views of a pressure detection module of the mode dial mechanism of the present invention.
Figure 4:
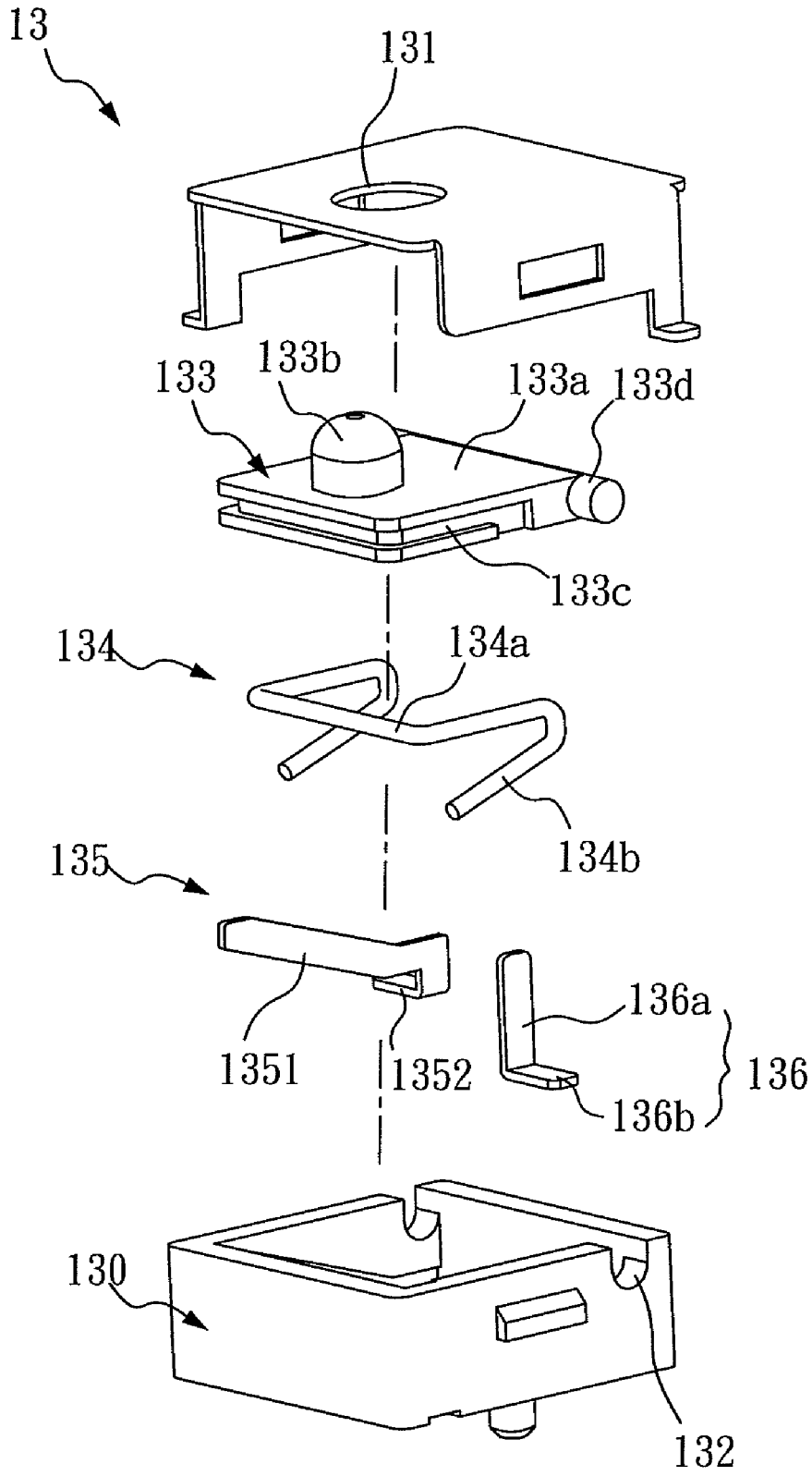

Please refer to FIG. 3 and FIG. 4. The pressure detection module 13 mentioned above comprises a containment casing 130. The outside top surface of the containment casing 130 is close to the bottom surface of the contact portion 102 and has a hole 131. In addition, the containment casing 130 has a shaft holder 132 formed on each of the two corresponding sides.

The pressure detection module 13 further comprises an action element 133. The action element 133 comprises a slab 133*a* removably received in the casing and a shaft 133*d* on a side. The shaft 133*d* pivots the shaft holder 132 of the containment casing 130. The aforementioned button portion 133*b* is located on the top surface of the slab 133*a*, passes through the hole 131, and touches the bottom surface of the contact portion 102. Additionally, in this embodiment, three lateral surfaces of the slab 133*a* of the action element 133 have a groove 133*c*.

The pressure detection module 13 further comprises an elastic electric member 134. The elastic electric member 134 comprises a fringe rod 134*a* disposed in the groove 133*c* of the action element 133 and a rebounding portion 134*b* formed by bending the end of the fringe rod 134*a* and which touches the inside bottom surface of the containment casing 130.

The pressure detection module 13 further comprises a resistance member 135 disposed within a side of the containment casing 130. The resistance member 135 comprises a metal board 1351 nestling up to the inside surface of the containment casing 130 at an angle and a conductive leg 1352 formed by bending the end of the metal board 1351 and which passes through the holding casing 130. The metal board 1351 contacts the fringe rod 134*a* of the elastic electric member 134. When the button portion 133*b* is pressed, which causes the slab 133*a* to descend, the contact position between the fringe rod 134*a* and the metal board 1351 differs such that a corresponding resistance value is generated. The purpose of the oblique metal board 1351 is to increase the length of the metal board 1351 to increase the range in which the elastic electric member 134 can move along the metal board 1351, which can reduce the occurrence of errors in the resistance value. The conductive leg 1352 is electrically coupled to the inside of the electronic device 1.

The pressure detection module 13 further comprises a conductive member 136 disposed within a side of the containment casing 130 different from the side on which the resistance member 135 is located. The conductive member 136 comprises a metal board 136*a* nestling up to the inside surface of the containment casing 130 perpendicularly and another conductive leg 136*b* formed by bending the end of the metal board 136*a* and that passes through the containment casing 130. The metal board 136*a* contacts the fringe rod 134*a* of the elastic electric member 134. The conductive leg 136*b* is electrically coupled to the inside of the electronic device 1.

Together with the aforementioned conductive leg 1352 of the resistance member 135, a closed circuit can be formed to output signals of the resistance to the electronic device 1.

Figure 5:
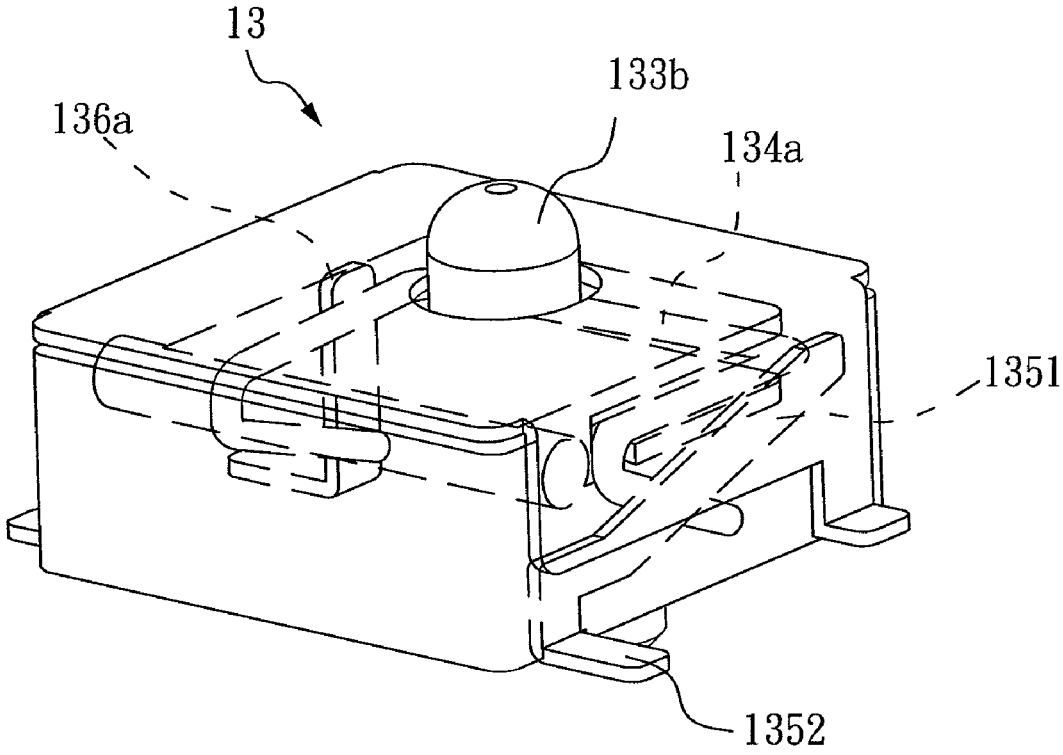
FIG. 5 and FIG. 6 are schematic drawings of the operation of the pressure detection module.

Please refer to FIG. 5, a schematic drawing of the pressure detection module 13 when the linear deformation caused by pressure of the button portion 133*b* is smaller. When the linear deformation caused by pressure of the button portion 133*b* is smaller, which indicates that the plane of the contact portion 102 of the aforementioned rotary member 10 that contacts the button portion 133*b* is higher, the fringe rod 134*a* of the elastic electric member 134 contacts the upper portion of the metal board 1351 of the resistance member 135. This causes electrical signals to flow through a longer path along the metal board 1351, thereby generating a larger resistance value.

Figure 6:
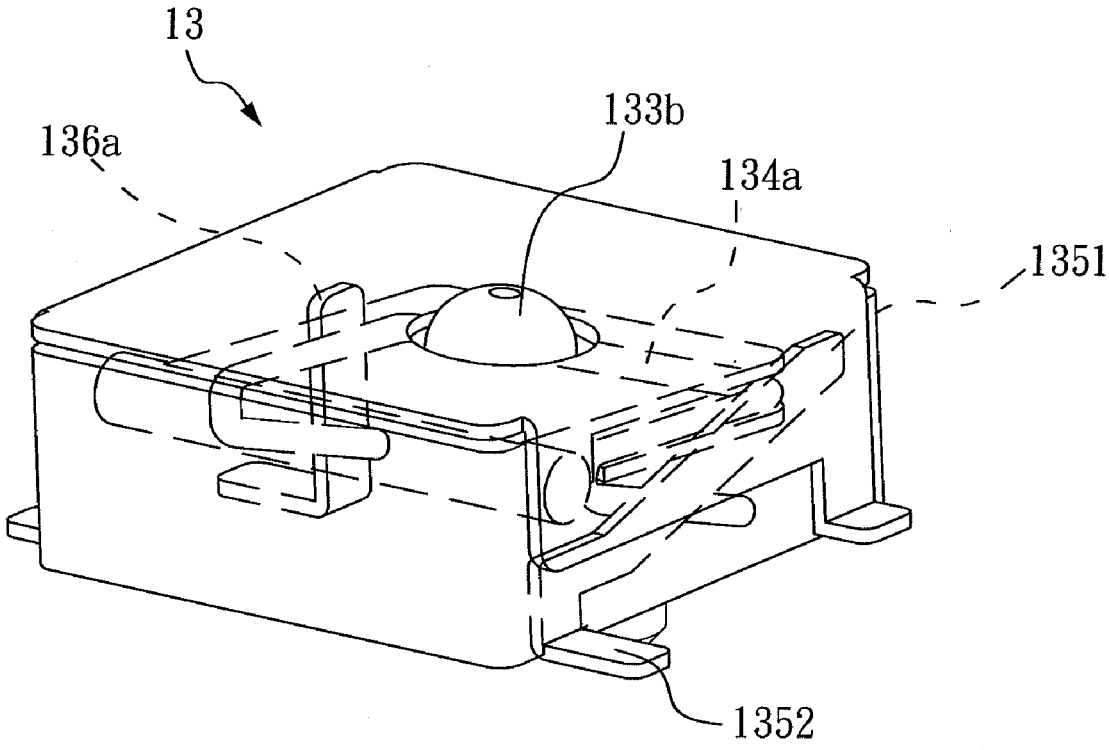

Please refer to FIG. 6, a schematic drawing of the pressure detection module 13 when the linear deformation caused by pressure of the button portion 133*b* is greater. When the linear deformation caused by pressure of the button portion 133*b* is greater, which indicates that the plane of the contact portion 102 of the aforementioned rotary member 10 that contacts the button portion 133*b* is lower, the fringe rod 134*a* of the elastic electric member 134 contacts the lower portion of the metal board 1351 of the resistance member 135. This causes electrical signals to flow through a shorter path along the metal board 1351, thereby generating a smaller resistance value.

Therefore, as long as the difference in resistance values of the button portion 133*b* of the pressure detection module 13 between the greater and the smaller linear deformations by pressure is obtained, the difference is then divided into certain levels, and the number of the operation modes for switching of the rotary member 10 can be determined. For example, let the resistance value of the button portion 133*b* be 100 with greater linear deformation by pressure, and let it be 0 with smaller linear deformation by pressure. Divide all those values between 0 and 100 into 10 levels, and there will be 10 operation modes for switching. However, the number of the levels should depend on the actual requirement.

In addition, a step mechanism can be set between the shaft portion 103 of the rotary member 10 and the electronic device 1 (not shown in the figures). Its purpose is to allow the user to confirm the switch between operation modes by sensing the shift in sections caused by the rotation of the rotary member 10.

Figure 7:
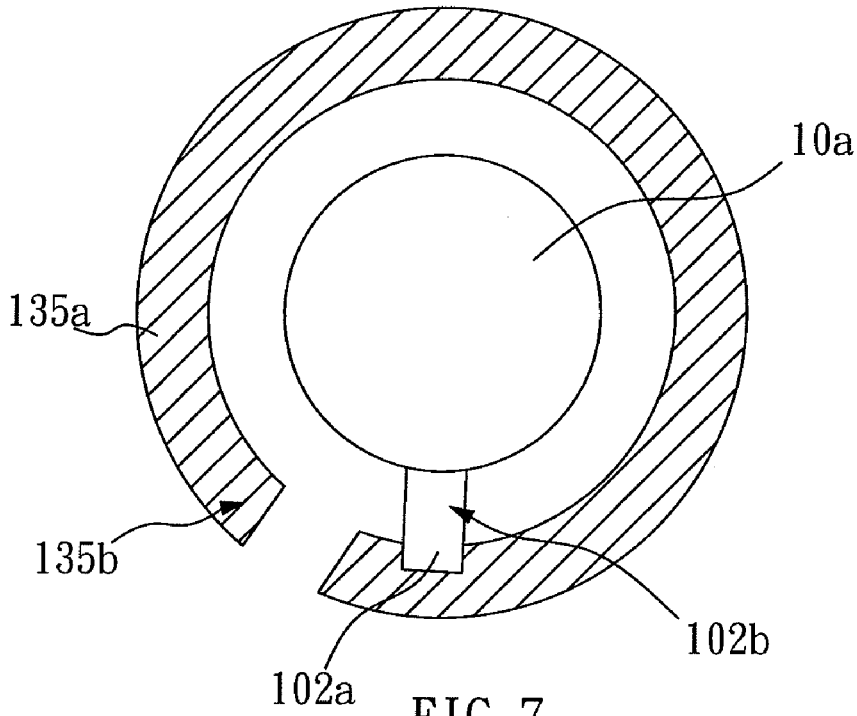
FIG. 7 and FIG. 7A are schematic drawings of the mode dial mechanism in accordance with a second embodiment of the present invention.
Figure 7A:
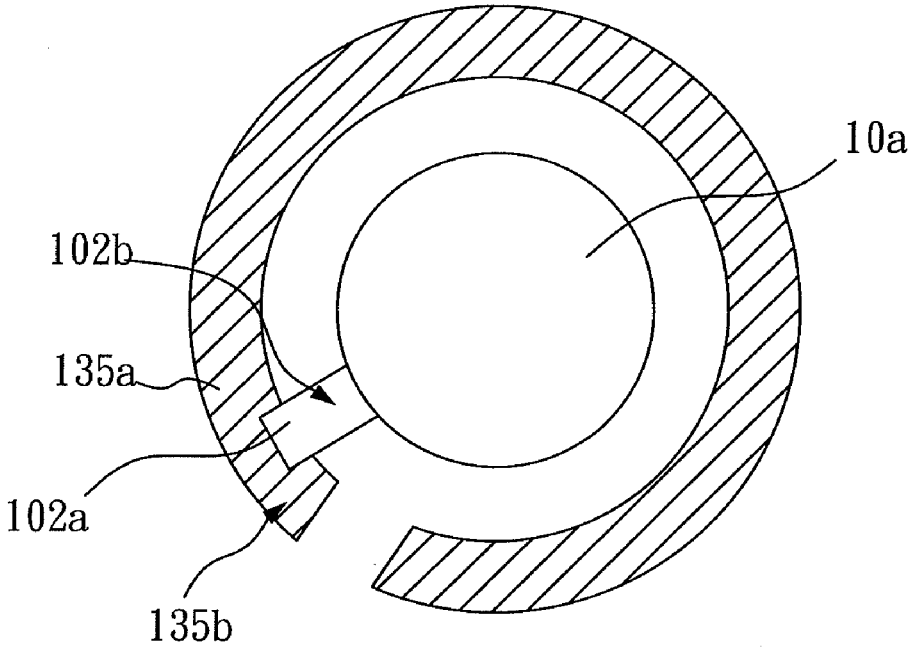

Next, please refer to FIG. 7 and FIG. 7A, schematic drawings of the mode dial mechanism in accordance with a second embodiment of the present invention. The mode dial mechanism of this embodiment comprises a resistance member 135*a* and a rotary member 10*a*. The rotary member 10*a* comprises a contact portion 102*a*. The resistance member 135*a* contacts the contact portion 102*a*. When the rotary member 10*a* is rotated, the contact portion 102*a* can move in an arc locus. In this embodiment, the contact portion 102*a* is a conductive slice, which has a contact 102*b* at its end electrically coupled to the electronic device 1 for transmitting signals. The resistance member 135*a* is a C-shaped metal member, and the C-shaped metal member has a contact 135*b* at one end electrically coupled to the electronic device 1 for transmitting signals.

When the rotary member 10*a* is turned to the position shown in FIG. 7, electrical signals flow through a longer path along the resistance member 135*a* (from the contact 135*b* to the contact 102*b*), thereby generating a larger resistance value.

When the rotary member 10*a* is rotated counterclockwise from the position shown in FIG. 7, the contact position between the contact portion 102*a* and the resistance member 135*a* differs. When the rotary member 10*a* is turned to the position shown in FIG. 7A, electrical signals flow through a shorter path along the resistance member 135*a* (from the contact 135*b* to the contact 102*b*), thereby generating a smaller resistance value.

Therefore, as long as the numerical relation between positions in which the rotary member 10*a* is turned to and the corresponding resistance values is obtained, the number of the operation modes for switching of the rotary member 10*a* can be determined.

Unlike the prior art electronic devices, which need to have a plurality of electrical contacts on their circuit board for mode dials, the mode dial mechanism and electronic device having the same of the present invention use a pressure detection module together with the bottom inclined plane of the rotary member of a simple structure to perform the mode switch. Its overall structure is simpler than that in the prior arts.

Furthermore, in the prior arts, a plurality of electrical contacts need to be located on the circuit board, and a conductive slice linking up with the rotary member needs to be set. This results in a complex process. However, the mode dial mechanism and electronic device having the same of the present invention simply need to have a pressure detection module connected to the electronic device, two conductive legs electrically coupled to the electronic device, and the rotary member located on and connected to the electronic device including the pressure detection module with a shaft. Its process is simpler than that in the prior arts.

Moreover, in the prior arts, when the operation-mode switch of the electronic device is moved, a conductive slice sometimes cannot precisely contact electrical contacts on the circuit board, thus resulting in a malfunction. However, the mode dial mechanism and electronic device having the same of the present invention determine the output resistance value according to the contact position between the elastic electric member of the pressure detection module and the metal board of the resistance member and then determines the switch between operation modes according to the resistance value. Therefore, its failure rate is reduced greatly.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A mode dial mechanism used for an electronic device, the mode dial mechanism comprising:

a rotary member comprising a main body with a bottom, a shaft portion connecting the main body and the electronic device, and a contact portion located at the bottom of the main body with an inclined surface; and a pressure detection module electrically coupled to the electronic device and located under the rotary member, with the pressure detection module comprising a button portion which is movable vertically, with the button portion contacting the contact portion;

when the rotary member is rotated, the contact portion pushes the button portion of the pressure detection module, and the pressure detection module outputs a signal according to a moving distance of the button portion;

wherein the pressure detection module comprises:

a containment casing having a outside top surface close to a bottom surface of the contact portion and having a hole;

an action element comprising a slab with a side removably received in the containment casing, wherein the button portion, which is located on the top surface of the slab, passes through the hole and touches the bottom surface of the contact portion;

an elastic electric member comprising a fringe rod disposed around the lateral surface of the slab and a rebounding portion formed by bending an end of the fringe rod and which touches an inside bottom surface of the containment casing;

a resistance member disposed within a side of the containment casing and touching the fringe rod of the elastic electric member; when the button portion is pressed, which causes the slab to descend, a contact position between the fringe rod and the resistance member differs such that a corresponding resistance value is generated; and a conductive member disposed within a side of the containment casing different from the side where the resistance member is located and touching the fringe rod of the elastic electric member, wherein three lateral surfaces of the action element have a groove, and wherein the fringe rod of the elastic electric member is an U-shaped metal rod that connects to the groove.

2. The mode dial mechanism as claimed in claim 1, wherein the resistance member comprises a metal board located on the inside bottom surface of the containment casing at an angle, and a conductive leg formed by bending an end of the metal board and which passes through the containment casing.

3. The mode dial mechanism as claimed in claim 1, wherein the conductive member comprises a metal board located on the inside bottom surface of the containment casing perpendicularly, and a conductive leg formed by bending an end of the metal board and which passes through the containment casing.

4. The mode dial mechanism as claimed in claim 1, wherein the action element has a shaft on a side, and the containment casing has a shaft holder formed on each of the sides of the containment casing, wherein two ends of the shaft pivot the shaft holder.

5. The mode dial mechanism as claimed in claim 1, wherein the mode dial mechanism comprises a step mechanism set between the shaft portion of the rotary member and the electronic device.

6. An electronic device having a plurality of operation modes, the electronic device comprising:

a rotary member comprising a main body with a bottom, a shaft portion connecting the main body and the electronic device, and a contact portion located at the bottom of the main body with an inclined surface;

a pressure detection module electrically coupled to the electronic device and located under the rotary member, with the pressure detection module comprising a button portion which is movable vertically, with the button portion contacting the contact portion;

when the rotary member is rotated, the contact portion pushes the button portion of the pressure detection module, and according to moving distances of the button portion, the pressure detection module outputs signals corresponding to each respective operation mode; and a central processing unit electrically coupled to the pressure detection module and executing corresponding operation modes according to signals output from the pressure detection module;

wherein the pressure detection module comprises:

a containment casing having an outside top surface close to a bottom surface of the contact portion and having a hole;

an action element comprising a slab with a side removably received in the containment casing, wherein the button portion, which is located on the top surface of the slab, passes through the hole and touches the bottom surface of the contact portion;

an elastic electric member comprising a fringe rod disposed around the lateral surface of the slab and a rebounding portion formed by bending an end of the fringe rod and which touches an inside bottom surface of the containment casing;

a resistance member disposed within a side of the containment casing and touching the fringe rod of the elastic electric member; when the button portion is pressed, which causes the slab to descend, a contact position between the fringe rod and the resistance member differs such that a corresponding resistance value is generated; and a conductive member disposed within a side of the containment casing different from the side on which the resistance member is located and touching the fringe rod of the elastic electric member, wherein three lateral surfaces of the action element have a groove, and wherein the fringe rod of the elastic electric member is an U-shaped metal rod that connects to the groove.

7. The electronic device as claimed in claim 6, wherein the resistance member comprises a metal board located on the inside bottom surface of the containment casing at an angle, and a conductive leg formed by bending an end of the metal board and which passes through the containment casing.

8. The electronic device as claimed in claim 6, wherein the conductive member comprises a metal board located on the inside bottom surface of the containment casing perpendicularly, and a conductive leg formed by bending an end of the metal board and which passes through the containment casing.

9. The electronic device as claimed in claim 6, wherein the action element has a shaft on a side, and the containment casing has a shaft holder formed on each of the sides of the containment casing, wherein two ends of the shaft pivot the shaft holder.

10. The electronic device as claimed in claim 6, wherein the shaft portion of the rotary member further has a step mechanism.

11. The electronic device as claimed in claim 6, wherein the signal output from the pressure detection module is a resistance signal.

12. The electronic device as claimed in claim 6, wherein the plurality of operation modes comprise a photo mode, a video mode, a play mode, a macro mode, an audio mode, or a moving mode.

13. The electronic device as claimed in claim 6, wherein the electronic device is a digital camera.

* * * * *